US006379535B1

(12) United States Patent
Hoehn et al.

(10) Patent No.: US 6,379,535 B1
(45) Date of Patent: Apr. 30, 2002

(54) HYDROCRACKING PROCESS

(75) Inventors: Richard K. Hoehn, Mount Prospect; Bradford L. Bjorklund, Schaumburg, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/556,805

(22) Filed: Apr. 25, 2000

(51) Int. Cl.[7] ..... C10G 65/02; C10G 69/02; C10G 47/00

(52) U.S. Cl. ..... 208/107; 208/108; 208/111.01; 208/111.35; 208/112; 208/49; 208/58

(58) Field of Search ..... 108/107, 108, 108/111.01, 111.35, 111.3, 112, 49, 58

(56) References Cited

U.S. PATENT DOCUMENTS

| | | | | |
|---|---|---|---|---|
| 3,328,290 A | | 6/1967 | Hengstebeck | 208/89 |
| 3,437,584 A | * | 4/1969 | Hamblin | 208/93 |
| 5,114,562 A | | 5/1992 | Haun et al. | 208/89 |
| 5,120,427 A | | 6/1992 | Stine et al. | 208/102 |
| 5,720,872 A | | 2/1998 | Gupta | 208/57 |

FOREIGN PATENT DOCUMENTS

| | | |
|---|---|---|
| WO | WO 97/38066 | 10/1997 |

* cited by examiner

*Primary Examiner*—Thuan D. Dang
(74) *Attorney, Agent, or Firm*—John G. Tolomei; John F. Spears, Jr.; John G. Cutts, Jr.

(57) ABSTRACT

A catalytic hydrocracking process wherein a hydrocarbonaceous feedstock and a liquid recycle stream is contacted with hydrogen in a hydrocracking reaction zone at elevated temperature and pressure to obtain conversion to lower boiling hydrocarbons. A liquid hydrocarbonaceous stream produced from the effluent of the hydrocracking reaction zone is fractionated in a first zone of a divided-wall fractionation zone to produce at least one liquid hydrocarbonaceous product stream and a liquid hydrocarbonaceous stream containing hydrocarbons boiling at a temperature in the boiling range of the feedstock and heavy polynuclear aromatic compounds. At least a portion of the liquid hydrocarbonaceous stream containing heavy polynuclear aromatic compounds is introduced into a second zone of the divided-wall fractionation zone to produce a stream rich in polynuclear aromatic compounds. At least another portion of the liquid hydrocarbonaceous stream containing hydrocarbons boiling at a temperature in the boiling range of the feedstock is recycled to the hydrocracking reaction zone.

7 Claims, 1 Drawing Sheet

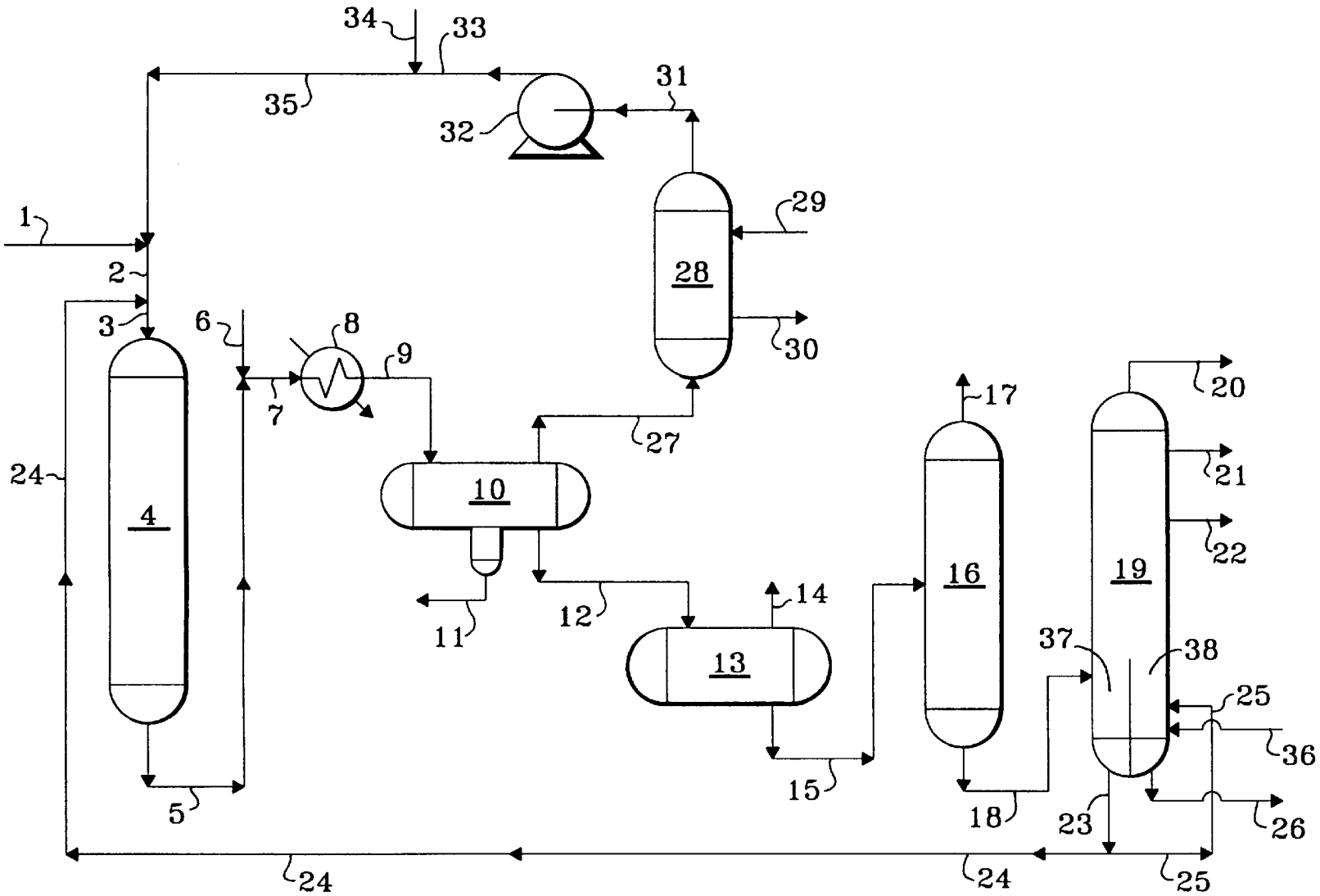
1
2
3
4
5
6
7
8
9
10
11
12
13
14
15
16
17
18
19
20
21
22
23
24
24
25
25
26
27
28
29
30
31
32
33
34
35
36
37
38

HYDROCRACKING PROCESS

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical heavy gas oil comprises a substantial portion of hydrocarbon components boiling above about 700° F., usually at least about 50 percent by weight boiling above 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Although a wide variety of process flow schemes, operating conditions and catalysts have been used in commercial activities, there is always a demand for new hydrocracking methods which provide lower costs, higher liquid product yields and improved operability.

INFORMATION DISCLOSURE

U.S. Pat. No. 5,720,872 (Gupta) discloses a process for hydroprocessing liquid feedstocks in two or more hydroprocessing stages which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

International Publication No. WO 97/38066 (PCT/US 97/04270) discloses a process for reverse staging in hydroprocessing reactor systems.

U.S. Pat. No. 3,328,290 (Hengstebech) discloses a two-stage process for the hydrocracking of hydrocarbons in which the feed is pretreated in the first stage.

U.S. Pat. No. 5,114,562 (Haun et al) discloses a process wherein a middle distillate petroleum stream is hydrotreated to produce a low sulfur and low aromatic product employing two reaction zones in series. The effluent of the first reaction zone is cooled and purged of hydrogen sulfide by stripping and then reheated by indirect heat exchange. The second reaction zone employs a sulfur-sensitive noble metal hydrogenation catalyst. Operating pressure and space velocity increase, and operating temperature decreases from the first to the second reaction zones. The '562 patent teaches that the hydroprocessing reactions of the hydrodenitrification and hydrodesulfurization will occur with very limited hydrocracking of the feedstock. Also, it is totally undesired to perform any significant cracking within the second reaction zone.

U.S. Pat. No. 5,120,427 (Stine et al) discloses a hydrocracking process wherein the product fractionation zone produces a net bottoms stream comprising polynuclear aromatic compounds. The liquid recycle stream from the fractionation zone is produced from a point above the feed point. The '427 patent fails to disclose a divided-wall fractionator to produce both a liquid recycle stream and a small drag stream from the bottom of the fractionator.

BRIEF SUMMARY OF THE INVENTION

The present invention is a catalytic hydrocracking process which uses a divided-wall fractionator to recover lower boiling hydrocarbon product streams, a liquid recycle stream and a drag stream containing a high concentration of heavy polynuclear aromatic compounds. The process of the present invention benefits from the ability to achieve a lower capital cost, lower operating expense and simplified operation.

In accordance with one embodiment, the present invention relates to a process for hydrocracking a hydrocarbonaceous feedstock which process comprises: (a) passing a hydrocarbonaceous feedstock, a liquid recycle stream and hydrogen to a hydrocracking zone containing hydrocracking catalyst; (b) partially condensing the effluent from the hydrocracking zone to produce a hydrogen-rich gaseous stream and a first liquid hydrocarbonaceous stream; (c) introducing at least a portion of the first liquid hydrocarbonaceous stream comprising hydrocarbons boiling at a temperature below the boiling range of the hydrocarbonaceous feedstock, hydrocarbons boiling at a temperature in the boiling range of the hydrocarbonaceous feedstock and heavy polynuclear aromatic compounds into a first zone of a divided-wall fractionation zone to produce at least one liquid hydrocarbonaceous product stream and a second liquid hydrocarbonaceous stream comprising hydrocarbons boiling at a temperature in the boiling range of the hydrocarbonaceous feedstock and heavy polynuclear aromatic compounds; (d) reintroducing at least a portion of the second liquid hydrocarbonaceous stream into a second zone located in the bottom end of the divided-wall fractionation zone to produce a third hydrocarbonaceous stream rich in polynuclear aromatic compounds; (e) recycling at least another portion of the second liquid hydrocarbonaceous stream to the hydrocracking zone to provide at least a portion of the liquid recycle stream; and (f) recovering the liquid hydrocarbonaceous product stream.

In accordance with another embodiment, the present invention relates to a process for hydrocracking a hydrocarbonaceous feedstock which process comprises: (a) passing a hydrocarbonaceous feedstock, a liquid recycle stream and hydrogen to a denitrification and desulfurization reaction zone containing a catalyst and recovering a denitrification and desulfurization reaction zone effluent therefrom; (b) passing the denitrification and desulfurization reaction zone effluent to a hydrocracking zone containing hydrocracking catalyst; (c) partially condensing the reaction zone effluent from step (b) to produce a hydrogen-rich gaseous stream and a first liquid hydrocarbonaceous stream; (d) passing the first liquid hydrocarbonaceous stream to a flashing zone having a reduced pressure to produce a first gaseous stream comprising hydrogen and normally gaseous hydrocarbons and a second liquid hydrocarbonaceous stream; (e) stripping the second liquid hydrocarbonaceous stream to produce a second gaseous stream comprising normally gaseous hydrocarbons and a third liquid hydrocarbonaceous stream comprising hydrocarbons boiling at a temperature below the boiling range of the hydrocarbonaceous feedstock, hydrocarbons boiling at a temperature in the boiling range of the hydrocarbonaceous feedstock and heavy polynuclear aromatic compounds; (f) fractionating the third liquid hydrocarbonaceous stream in a first zone of a divided-wall fractionation zone to produce at least one liquid hydrocarbonaceous product stream and a fourth liquid hydrocarbonaceous stream comprising hydrocarbons boiling at a temperature in the boiling range of the hydrocarbonaceous feedstock and heavy polynuclear aromatic compounds; (g) reintroducing at least a portion of the fourth liquid hydrocarbonaceous stream into a second zone located in the bottom end of the divided-wall fractionation zone to produce a fifth hydrocarbonaceous stream rich in polynuclear aromatic compounds; (h) recycling at least another portion of the fourth liquid hydrocarbonaceous stream to the denitrification and desulfurization reaction zone to provide at least a portion of the liquid recycle stream; and (i) recovering the liquid hydrocarbonaceous product stream.

Other embodiments of the present invention encompass further details such as types and descriptions of feedstocks, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a divided-wall fractionation zone may be successfully utilized to produce various product streams from a hydrocracking reaction zone including, for example, naphtha, kerosene and diesel hydrocarbon streams while simultaneously preparing a liquid hydrocarbonaceous recycle stream having a reduced concentration of heavy polynuclear aromatic compounds and a small hydrocarbon slip stream containing an enhanced concentration of heavy polynuclear aromatics.

The process of the present invention is particularly useful for hydrocracking a hydrocarbonaceous oil containing hydrocarbons and/or other organic materials to produce a product containing hydrocarbons and/or other organic materials of lower average boiling point and lower average molecular weight. The hydrocarbonaceous feedstocks that may be subjected to hydrocracking by the method of the invention include all mineral oils and synthetic oils (e.g., shale oil, tar sand products, etc.) and fractions thereof. Illustrative hydrocarbonaceous feedstocks include those containing components boiling above 550° F., such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at temperatures above the end point of the desired product, which end point, in the case of heavy gasoline, is generally in the range from about 380° F. to about 420° F. One of the most preferred gas oil feedstocks will contain hydrocarbon components which boil above 550° F. with best results being achieved with feeds containing at least 25 percent by volume of the components boiling between 600° F. and 1000° F.

Also included are petroleum distillates wherein at least 90 percent of the components boil in the range from about 300° F. to about 800° F. The petroleum distillates may be treated to produce both light gasoline fractions (boiling range, for example, from about 50° F. to about 185° F.) and heavy gasoline fractions (boiling range, for example, from about 185° F. to about 400° F.).

In one embodiment of the present invention the selected feedstock is first introduced into a denitrification and desulfurization reaction zone together with a liquid recycle stream and hydrogen at hydrotreating reaction conditions. Preferred denitrification and desulfurization reaction conditions or hydrotreating reaction conditions include a temperature from about 400° F. to about 900° F., a pressure from about 500 psig to about 2500 psig, a liquid hourly space velocity of the fresh hydrocarbonaceous feedstock from about 0.1 $hr^{-1}$ to about 10 $hr^{-1}$ with a hydrotreating catalyst or a combination of hydrotreating catalysts.

The term "hydrotreating" as used herein refers to processes wherein a hydrogen-containing treat gas is used in the presence of suitable catalysts which are primarily active for the removal of heteroatoms, such as sulfur and nitrogen and for some hydrogenation of aromatics. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical hydrotreating temperatures range from about 400° F. to about 900° F. with pressures from about 500 psig to about 2500 psig, preferably from about 500 psig to about 2000 psig.

In one embodiment of the present invention the resulting effluent from the denitrification and desulfurization reaction zone is then introduced into a hydrocracking zone. The hydrocracking zone may contain one or more beds of the same or different catalyst. In one embodiment, when the preferred products are middle distillates, the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking reactor conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 5 volume percent of the fresh feedstock. In a preferred embodiment, the per pass conversion in the hydrocracking zone is in the range from about 15% to about 60%.

The resulting effluent from the hydrocracking reaction zone is contacted with an aqueous stream and partially condensed, and then introduced into a high pressure vapor-liquid separator operated at a pressure substantially equal to the hydrocracking zone and a temperature in the range from about 100° F. to about 160° F. A hydrogen-rich gaseous stream is removed from the vapor-liquid separator to provide at least a portion of the hydrogen introduced into the denitrification and desulfurization reaction zone as hereinabove described.

Fresh make-up hydrogen may be introduced into the process at any suitable and convenient location. Before the hydrogen-rich gaseous steam from the vapor-liquid separator is introduced into the denitrification and desulfurization reaction zone, it is preferred that at least a significant amount of the hydrogen sulfide is removed and recovered by means of known, conventional methods. In a preferred embodiment, the hydrogen-rich gaseous stream introduced into the denitrification and desulfurization reaction zone contains less than about 50 wppm hydrogen sulfide.

A liquid hydrocarbonaceous stream is recovered from the vapor-liquid separator and is passed to a second vapor-liquid separator having a lower pressure to produce a gaseous stream containing hydrogen and normally gaseous hydrocarbons and another liquid hydrocarbonaceous stream which is passed to a stripper column to produce a gaseous stream containing normally gaseous hydrocarbons and a liquid hydrocarbonaceous stream containing trace quantities of heavy polynuclear aromatic compounds which is passed to a first zone in a divided-wall fractionation zone to produce at least one hydrocracked hydrocarbonaceous product stream and a bottoms liquid hydrocarbonaceous stream containing hydrocarbonaceous compounds boiling in the range of the hydrocarbonaceous feedstock and heavy polynuclear aromatic compounds. At least a portion of the bottoms liquid hydrocarbonaceous stream containing hydrocarbonaceous compounds boiling in the range of the hydrocarbonaceous feedstock and heavy polynuclear aromatic compounds is recycled to the denitrification and desulfurization reaction zone as described hereinabove.

At least a portion of the bottoms liquid hydrocarbonaceous stream containing hydrocarbonaceous compounds boiling in the range of the hydrocarbonaceous feedstock and heavy polynuclear aromatic compounds which stream is removed from the first zone of the divided-wall fractionation zone is introduced into a second zone located in the bottom end of the divided-wall fractionation zone and preferably stripped with steam to flash off hydrocarbonaceous compounds boiling in the range of the hydrocarbonaceous feedstocks and to produce a heavy bottoms stream rich in heavy polynuclear aromatic compounds. In order to achieve the maximum advantage of the process of the present invention, it is preferred that the heavy bottoms stream rich in heavy polynuclear aromatic compounds is in an amount less than about 1 weight percent of the hydrocarbonaceous feedstock.

In another embodiment of the present invention, the hydrocracking process may be performed without a denitrification and desulfurization reaction zone and with one or more hydrocracking zones as long as at least a portion of an effluent from at least one hydrocracking zone is introduced into a divided-wall fractionation zone as herein described.

In accordance with the present invention, the divided-wall fractionation zone accepts a heated stream containing hydrocarbons boiling at a temperature below the boiling range of said hydrocarbonaceous feedstock, hydrocarbons boiling at a temperature in the boiling range of the hydrocarbonaceous feedstock and heavy polynuclear aromatic compounds to produce at least one liquid hydrocarbonaceous product stream and a liquid hydrocarbonaceous stream comprising hydrocarbons boiling at a temperature in the boiling range of the hydrocarbonaceous feedstock and heavy polynuclear aromatic compounds. Preferably the divided-wall fractionation zone produces one or more product streams including naphtha, kerosene and diesel, for example. The divided-wall fractionation zone is preferably constructed with a solid dividing wall located in the lower end of the fractionation zone to partition the lower end to provide two separate zones which contain and maintain two separate liquids. The dividing wall is necessarily constructed to prevent the admixture of the two liquids while permitting the movement of vapor from each zone to the upper end of the fractionation zone. Since the liquid volumetric flow rates are expected to be unequal in the two zones, it is preferred that the zone having the lower flow rate be proportionally smaller than the other zone in order to efficiently utilize the total volume available in the lower end of the fractionation zone.

The heated feed to the divided-wall fractionation zone may be introduced at any convenient place or elevation including either above or below the upper end of the dividing wall in order to effect the desired fractionation and product generation. The introduction of the liquid stream into the fractionation zone to produce a stream rich in heavy polynuclear aromatic compounds is preferably made at a location below the upper end of the dividing wall in order to prevent cross-contamination by heavy polynuclear aromatic compounds between the two zones defined by the dividing wall.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil and heavy coker gas oil is introduced into the process via line 1 and admixed with a hydrogen-rich recycle gas transported via line 35. The resulting admixture is carried via line 2 and admixed with a hereinafter-described recycle oil transported via line 24. This resulting admixture is then transported via line 3 into combination reaction zone 4 and is contacted with a denitrification and desulfurization catalyst. A resulting effluent from the denitrification and desulfurization catalyst is passed into a hydrocracking catalyst which is also contained in combination reaction zone 4. A resulting hydrocracked effluent from combination reaction zone 4 is carried via line 5 and is admixed with a water wash stream introduced via line 6 and the resulting admixture is transported via line 7 and introduced into heat-exchanger 8. A resulting cooled effluent from heat-exchanger 8 is transported via line 9 and introduced into vapor-liquid separator 10. A spent water wash stream is removed from vapor-liquid separator 10 via line 11. A hydrogen-rich gaseous stream containing hydrogen sulfide is removed from vapor-liquid separator 10 via line 27 and introduced into gas recovery zone 28. A lean solvent is introduced via line 29 into acid gas recovery zone 28 and contacts the hydrogen-rich gaseous stream in order to adsorb an acid gas. A rich solvent containing acid gas is removed from acid gas recovery zone 28 via line 30 and recovered. A hydrogen-rich gaseous stream containing a reduced concentration of acid gas is removed from acid gas recovery zone 28 via line 31, compressed in compressor 32. A compressed hydrogen-rich gaseous recycle stream is transported via line 33 and is admixed with a make-up hydrogen gaseous stream carried via line 34 and the resulting admixture is transported via line 35 and is admixed with the fresh feedstock as hereinabove described. A liquid hydrocarbonaceous stream is removed from vapor-liquid separator 10 via line 12 and is introduced into low pressure flash zone 13. A vaporous stream containing hydrogen and normally gaseous hydrocarbons is removed from low pressure flash zone 13 via line 14 and recovered. A liquid hydrocarbonaceous stream is removed from low pressure flash zone 13 via line 15 and introduced into stripper 16. A gaseous stream containing normally gaseous hydrocarbon compounds is removed from stripper 16 via line 17 and recovered. A liquid hydrocarbonaceous stream is removed from stripper 16 via line 18 and introduced into divided-wall fractionation zone 19. A naphtha boiling range hydrocarbon stream is removed from divided-wall fractionation zone 19 via line 20 and recovered. A kerosene boiling range hydrocarbonaceous stream is removed from divided-wall fractionation zone 19 via line 21 and recovered. A diesel boiling range hydrocarbonaceous stream is removed from divided-wall fractionation zone 19 via line 22 and recovered. A bottoms stream containing hydrocarbons boiling in the range of the fresh feedstock and containing heavy polynuclear aromatic compounds is removed from zone 37 located in the lower portion of divided-wall fractionation zone 19 via line 23. At least a portion of the hydrocarbonaceous stream carried via line 23 is transported via line 24 and recycled as hereinabove described. Another portion of the hydrocarbonaceous stream carried via line 23 is transported via line 25 and introduced into zone 38 located in the lower portion of divided-wall fractionation zone 19. Zone 38 of divided-wall fractionation zone 19 is stripped with steam which is introduced via line 36. A heavy hydrocarbonaceous stream containing an enhanced level of heavy polynuclear aromatic compounds is removed from zone 38 of divided-wall fractionation zone 19 via line 26 and recovered.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

The following is an illustration of the hydrocracking process of the present invention while hydrocracking a well-known feedstock whose pertinent characteristics are presented in Table 1.

TABLE 1

HYDROCRACKER FEEDSTOCK ANALYSIS

80% Vacuum Gas Oil/20% Coker Gas Oil from Arabian Crude

| | |
|---|---|
| Gravity, ° API | 21.0 |
| Specific Gravity @ 60° F. | 0.928 |
| Distillation, Volume Percent | |
| IBP, ° F. | 664 |
| 10 | 716 |
| 50 | 817 |
| 90 | 965 |
| EP | 1050 |
| Sulfur, weight percent | 3.0 |
| Nitrogen, weight ppm | 1250 |
| Conradson Carbon, weight percent | 0.36 |
| Bromine Number | 7.5 |

The goal of the present invention is to maximize selectivity to middle distillate hydrocarbons boiling in the range of 260° F. to about 730° F. Diesel fuel, one of the components of middle distillate, also requires a maximum of 50 ppm sulfur, a minimum cetane index of 50 and a 95 volume percent boiling point of 662° F. (350° C.).

One hundred volume units of the hereinabove-described feedstock is admixed with 200 volume units of a hereinafter-described recycle stream and recycle hydrogen, and is introduced into a hydrotreating catalyst zone operated at hydrotreating conditions including a pressure of 1900 psig, a hydrogen circulation rate of 4,000 SCFB and a temperature of 750° F. The effluent from the hydrotreating catalyst zone is directly introduced into a hydrocracking catalyst zone operated at a temperature of 770° F. The resulting effluent from the hydrocracking catalyst zone is partially condensed and introduced into a high pressure vapor-liquid separator. A hydrogen-rich gaseous stream is removed from the high pressure vapor-liquid separator and at least a portion after acid gas scrubbing is recycled to the hydrotreating catalyst zone. A liquid hydrocarbonaceous stream is removed from the high pressure vapor-liquid separator and introduced into a low pressure vapor-liquid separator to produce a vapor stream containing hydrogen and normally gaseous hydrocarbons, and a liquid hydrocarbonaceous stream which is introduced into a stripper column. A stripped liquid hydrocarbonaceous stream is removed from the stripper column and introduced into a divided-wall fractionation zone to produce the products listed in Table 2.

A heavy liquid hydrocarbonaceous stream containing hydrocarbon compounds boiling in the range of the hydrocarbonaceous feedstock and heavy polynuclear aromatic compounds in an amount of 50 weight ppm is removed from a first isolated section in the bottom of the divided-wall fractionation zone and 200 volume units are recycled and admixed with the fresh feedstock and 3 volume units are introduced into a second isolated section in the bottom of the divided-wall fractionation zone and stripped with steam. A heavy liquid hydrocarbonaceous stream in an amount of 0.5 volume units and rich in heavy polynuclear aromatic compounds is removed from the second isolated section in the bottom of the divided-wall fractionation zone and recovered.

TABLE 2

PRODUCT YIELDS

| | Volume Units |
|---|---|
| Butane | 3.2 |
| Light Naphtha | 7.8 |
| Heavy Naphtha | 9.4 |
| Turbine Fuel | 45.3 |
| Diesel Fuel | 48.2 |

The foregoing description, drawing and illustrative embodiment clearly illustrate the advantages encompassed by the process of the present invention and the benefits to be afforded with the use thereof.

What is claimed:

1. A process for hydrocracking a hydrocarbonaceous feedstock which process comprises:

(a) passing a hydrocarbonaceous feedstock, a liquid recycle stream and hydrogen to a denitrification and desulfurization reaction zone containing a catalyst and recovering a denitrification and desulfurization reaction zone effluent therefrom;

(b) passing said denitrification and desulfurization reaction zone effluent to a hydrocracking zone containing hydrocracking catalyst;

(c) partially condensing the reaction zone effluent from step (b) to produce a hydrogen-rich gaseous stream and a first liquid hydrocarbonaceous stream;

(d) passing said first liquid hydrocarbonaceous stream to a flashing zone having a reduced pressure to produce a first gaseous stream comprising hydrogen and normally gaseous hydrocarbons and a second liquid hydrocarbonaceous stream;

(e) stripping said second liquid hydrocarbonaceous stream to produce a second gaseous stream comprising normally gaseous hydrocarbons and a third liquid hydrocarbonaceous stream comprising hydrocarbons boiling at a temperature below the boiling range of said hydrocarbonaceous feedstock, hydrocarbons boiling at a temperature in the boiling range of said hydrocarbonaceous feedstock and heavy polynuclear aromatic compounds;

(f) fractionating said third liquid hydrocarbonaceous stream in a first zone of a divided-wall fractionation zone to produce at least one liquid hydrocarbonaceous product stream and a fourth liquid hydrocarbonaceous stream comprising hydrocarbons boiling at a temperature in the boiling range of said hydrocarbonaceous feedstock and heavy polynuclear aromatic compounds;

(g) reintroducing at least a portion of said fourth liquid hydrocarbonaceous stream into a second zone located in the bottom end of said divided-wall fractionation zone to produce a fifth hydrocarbonaceous stream rich in polynuclear aromatic compounds;

(h) recycling at least another portion of said fourth liquid hydrocarbonaceous stream to said denitrification and desulfurization reaction zone to provide at least a portion of said liquid recycle stream; and (i) recovering said liquid hydrocarbonaceous product stream.

2. The process of claim 1 wherein said denitrification and desulfurization reaction zone is operated at reaction zone conditions including a temperature from about 400° F. to about 900° F., a pressure from about 500 psig to about 2500 psig and a liquid hourly space velocity of said hydrocarbonaceous feedstock from about 0.1 $hr^{-1}$ to about 10 $hr^{-1}$.

3. The process of claim 1 wherein said hydrocracking zone is operated at conditions including a temperature from about 400° F. to about 900° F., a pressure from about 500 psig to about 2500 psig and a liquid hourly space velocity from about 0.1 $hr^{-1}$ to about 15 $hr^{-1}$.

4. The process of claim 1 wherein said hydrocarbonaceous feedstock boils in the range from about 450° F. to about 1050° F.

5. The process of claim 1 wherein said hydrocracking zone is operated at a conversion per pass in the range from about 15% to about 60%.

6. The process of claim 1 wherein said denitrification and desulfurization reaction zone contains a catalyst comprising nickel and molybdenum.

7. The process of claim 1 wherein said fifth hydrocarbonaceous stream rich in polynuclear aromatic compounds is less than about 1 weight percent of said hydrocarbonaceous feedstock.

* * * * *